US005464001A

United States Patent [19]

Peck

[11] Patent Number: 5,464,001

[45] Date of Patent: Nov. 7, 1995

[54] ADJUSTABLE COMPOUND BOW

[76] Inventor: Kenneth Peck, 1895 Jumpoff Joe Cr. Rd., Grants Pass, Oreg. 97526

[21] Appl. No.: 168,128

[22] Filed: Dec. 17, 1993

[51] Int. Cl.[6] ..... F41B 5/00

[52] U.S. Cl. ..... 124/25.6; 124/23.1; 124/88

[58] Field of Search ..... 124/25.6, 23.1, 124/24.1, 86, 88

[56] References Cited

U.S. PATENT DOCUMENTS

| | | | |
|---|---|---|---|
| 3,486,495 | 12/1969 | Allen | 124/24 |
| 3,987,777 | 10/1976 | Darlington | 124/23 R |
| 4,060,066 | 11/1977 | Kudlacek | 124/23 R |
| 4,178,905 | 12/1979 | Groner | 124/23 R |
| 4,644,929 | 2/1987 | Peck | 124/23.1 |
| 4,674,468 | 6/1987 | Izuta | 124/23.1 |
| 4,793,319 | 12/1988 | Vaughan et al. | 124/23 R |
| 5,025,774 | 6/1991 | Martin | 124/23.1 X |
| 5,099,819 | 3/1992 | Simonds et al. | 124/25.6 X |
| 5,172,679 | 12/1992 | Mussack | 124/25.6 |
| 5,231,970 | 8/1993 | Ploot et al. | 124/23.1 |
| 5,241,945 | 9/1993 | Shepley, Jr. | 124/88 |
| 5,280,779 | 1/1994 | Smith | 124/23.1 X |

FOREIGN PATENT DOCUMENTS

| | | | |
|---|---|---|---|
| 2580795 | 10/1986 | France | 124/23.1 |

*Primary Examiner*—Randolph A. Reese
*Assistant Examiner*—Harry C. Kim
*Attorney, Agent, or Firm*—Jacobson, Price, Holman & Stern

[57] ABSTRACT

A degree of adjustability is achieved by securing an end of a bow limb within a bow limb pocket. The bow limb pockets are secured to opposite ends of a handle member. The bow limb pockets are adjustable in a direction transverse and perpendicular to a longitudinal axis of the handle member for fine lateral adjustment of the bow pulleys with respect to the handle member. A series of grooves parallel to each other are cut in opposite ends of the handle member with complementary shaped grooves located on a rear surface of each of the two pocket members. The grooves of the handle member and the bow limb pockets extend parallel to the longitudinal axis of the handle member when the handle member and bow limb pockets are assembled together. The grooves mate with one another at which point a bolt is driven through the bow limb pocket into one end of the handle member. A bow limb is then secured to the bow limb pocket and the compound bow may then be strung.

12 Claims, 2 Drawing Sheets

26
34
30
22
10
18
14
12
38
16
20
24
32
28
36

18
40
42
38
46
44
20

ADJUSTABLE COMPOUND BOW

FIELD OF THE INVENTION

The present invention relates to a compound bow having limbs of the bow mounted in bow limb pockets which are adjustably mounted on a handle portion of the bow so that a fine lateral adjustment of the bow pulleys is possible for a precise alignment and tuning of the bow.

BACKGROUND OF THE INVENTION

In U.S. Pat. No. 3,486,495 to Allen, a handle portion receives end portions of two separate limbs of a bow. A pivot pin extends through the handle portion and the limbs to mount the limbs for swinging movement about an axis of the pin. A threaded shank extends through an opening in the lower end of each limb and is held by a nut recessed into the handle section. An adjustment knob is rigid with the outer end of the shank and the base of the channel within which the two limbs are disposed is arcuate in configuration for swinging movement about the pivot pins of the limbs upon rotation of the knobs. The adjustment movement of the limbs in this patent is parallel to the longitudinal axis of the handle portion.

Similarly, in U.S. Pat. No. 4,178,905 to Groner, a compound bow adjustment mechanism is disclosed for adjustment of a pair of limb members in a plane passing through a longitudinal axis of a handle member.

Other mechanisms for adjustment of limb members in a compound archery bow are disclosed in U.S. Pat. No. 3,987,777 to Darlington as well as U.S. Pat. No. 4,060,066 to Kudlacek. As in the previously referred to patents, these two patents disclose an adjustability of the bow limb members for movement in a plane passing through a longitudinal axis of a handle member to which the bow limb members are secured.

SUMMARY OF THE INVENTION

By the present invention, an entirely different degree of adjustability is achieved by securing an end of a bow limb within a bow limb pocket. The bow limb pockets are secured to opposite ends of a handle member. The bow limb pockets are adjustable in a direction transverse and perpendicular to a longitudinal axis of the handle member for fine lateral adjustment of the bow pulleys with respect to the handle member.

A series of grooves parallel to each other are cut in opposite ends of the handle member with complementary shaped grooves located on a rear surface of each of the two pocket members. The grooves of the handle member and the bow limb pockets extend parallel to the longitudinal axis of the handle member when the handle member and bow limb pockets are assembled together. The grooves mate with one another at which point a bolt is driven through the bow limb pocket into one end of the handle member. A bow limb is then secured to the bow limb pocket and the compound bow may then be strung.

If an adjustment in the positioning of the bow pulleys is necessary, the bow limb is removable from the bow limb pocket and the bow limb pocket is adjustable in a left or right side direction in its movement with respect to each end of the handle member for exact tuning of the compound bow. Once a lateral adjustment of the bow limb pocket has been made, the bow limb is resecured within the pocket and the bow limb pocket and the bow limb are secured to the end of the handle member for a precise calibration of the compound bow.

It is therefore an object of the present invention to provide a compound bow having bow limbs laterally adjustable with respect to a longitudinal axis of a handle member.

It is yet another object of the present invention to provide a compound bow having bow limbs laterally adjustable with respect to a longitudinal axis of a handle member with the bow limbs fitting within a bow limb pocket which is adjustable with respect to the handle member.

It is yet another object of the present invention to provide a compound bow having bow limbs laterally adjustable with respect to a longitudinal axis of a handle member with the bow limbs fitting within a bow limb pocket which is adjustable with respect to the handle member with the bow limb pockets and opposite ends of the handle member including a plurality of grooves aligned parallel to a longitudinal axis of the handle member for adjustment of the bow limbs in a direction perpendicular to the longitudinal axis of the handle member.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
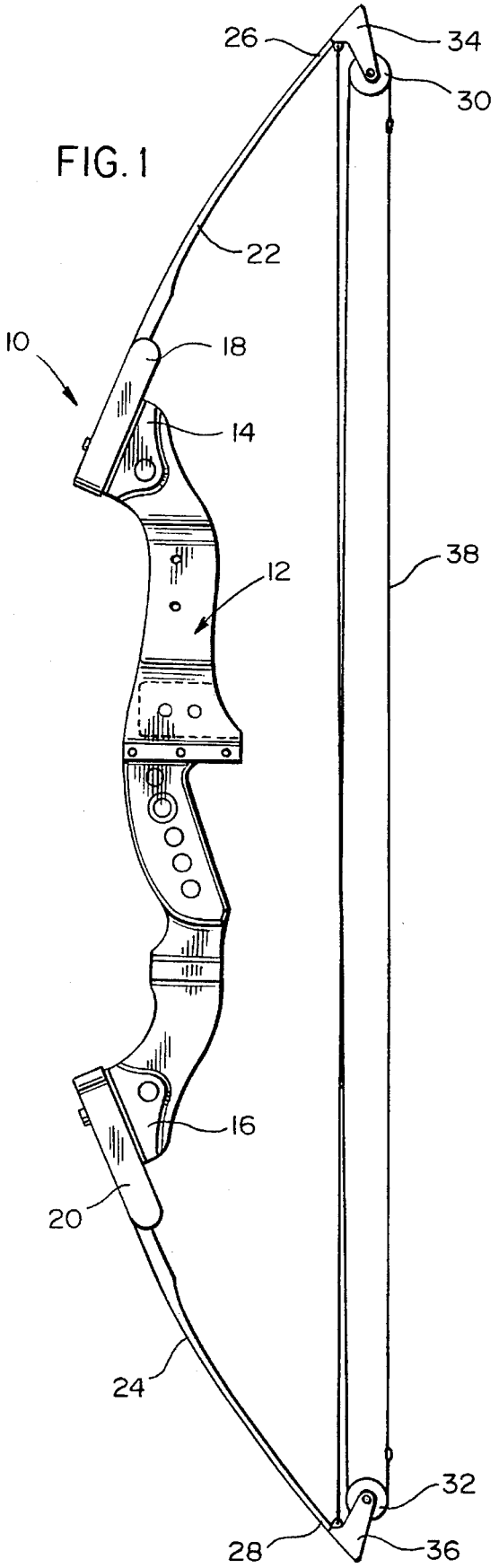
FIG. 1 is a side elevational view of a compound bow.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
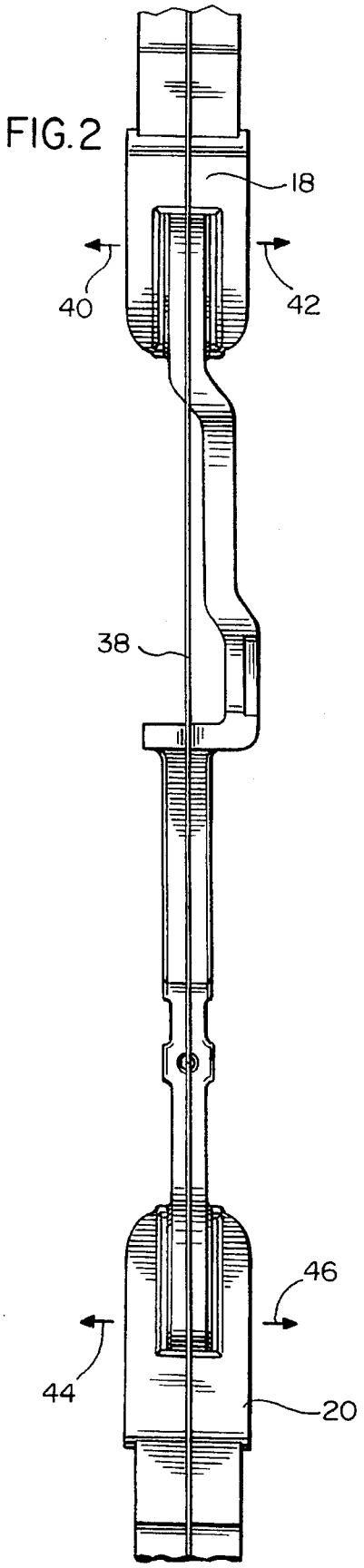
FIG. 2 is a rear view of a portion of the compound bow.

With reference to the drawings, in general, and to FIGS. 1 and 2, in particular, a compound bow embodying the teachings of the subject invention is generally designated as 10. With reference to its orientation in FIG. 1, the compound bow 10 includes a handle member 12 having opposite ends 14 and 16.

Attached to ends 14 and 16 are bow limb pockets 18. Secured within bow limb pockets 18 and 20 are bow limbs 22, 24. At ends 26, 28, respectively, of the bow limbs 22, 24 are pulley members 30, 32 mounted within securing members 34, 36, respectively. A bow string 38 is trained about the pulley members 30, 32 and secured at ends 26 and 28 of the bow limbs 22, 24.

In FIG. 2, the bow string 38 is shown extending along a longitudinal axis of the handle member 12. By the present invention, bow limb pockets 18 and 20 are movable perpendicular to the longitudinal axis of the handle member in the direction of arrows 40, 42 for bow limb pocket 18 and arrows 44, 46 for bow limb pocket 20. This lateral adjustment of the bow limb pocket 18 and therefore the bow limbs 22, 24 and the pulleys 30, 32 allows for fine adjustment of the bow string 38 with respect to the handle member 12.

Figure 6:
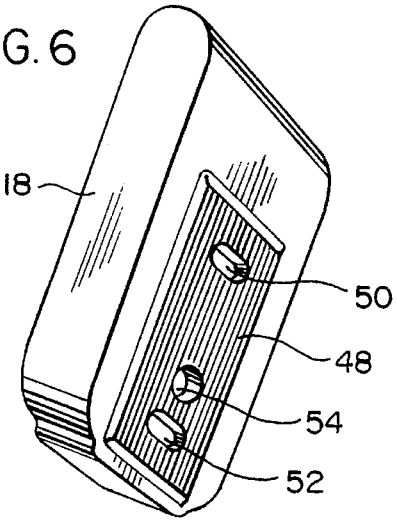
FIG. 6 is an enlarged rear view of a bow limb pocket.

Each bow limb pocket, for example bow limb pocket 18 shown in FIG. 6, includes a plurality of grooves or serrations 48 which produce an undulating pattern. Each bow limb pocket also includes two elongated holes 50 and 52 as well as a cylindrical hole 54. The elongated holes 50, 52 allow for lateral adjustment of the bow limb pocket with respect to an end of the handle member.

Figure 7:
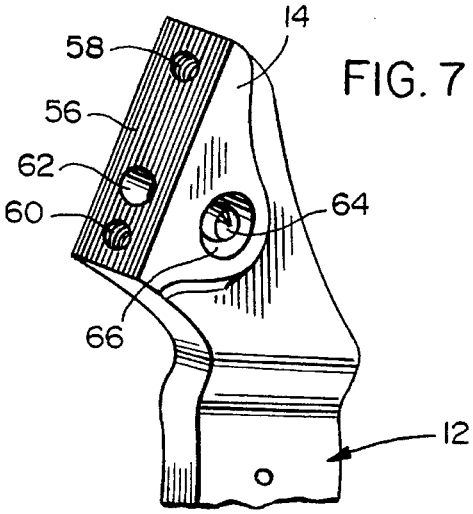
FIG. 7 is an enlarged perspective view of one end of a handle member.

In FIG. 7, end 14 of handle member 12 is shown which is representative also of end 16 of the handle member 12. The end 14 includes a plurality of grooves or serrations 56 which are shaped complementary to the grooves or serrations 48 of the pocket members so as to produce a similar undulating pattern. At the top and bottom of the grooves 56 are two threaded bore holes 58 and 60 for receipt of bolts passing through elongated holes 50 and 52, respectively. Smooth cylindrical hole 62 is for receipt of a shaft of a bolt passing through opening 54 of the bow limb pockets. Hole 62 terminates in an axially aligned hole 64 which extends, as does hole 62, from a perpendicular extending cylindrical opening 66 which is also shown in FIG. 4.

Figure 5:
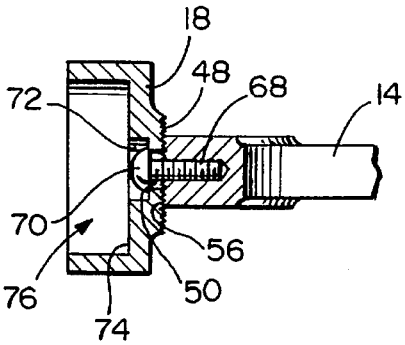
FIG. 5 is a sectional view taken along line 5—5 of FIG. 4.

In FIG. 5, a representative bow limb pocket 18 is shown secured to end 14 of handle member 12 by a threaded bolt 68 extending through hole 50 so as to secure the pocket member 18 to the end 14 of handle member 12. The head 70 of the bolt 68 fits within a recessed slot 72 which opens into hole 50 so as to retain the head 70 of the bolt 68 within the recessed slot 72 below a bottom surface 74 of a channel 76 formed by the bow limb pocket 18. A similar recessed slot 78 communicates with hole 52 for receipt of a bolt 80 having head 82 for securing the bow limb pocket, with the grooves 48 mating with the grooves 56 for a rigid connection of the bow limb pocket 18 with the end 14 or 16 of the handle member 12.

Figure 3:
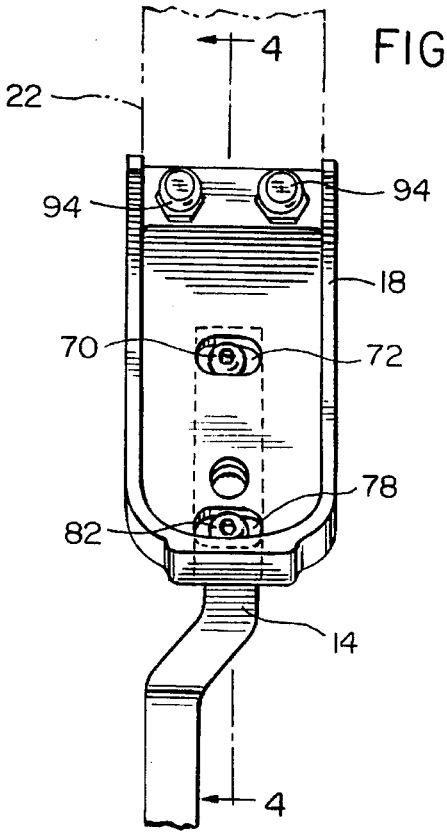
FIG. 3 is an enlarged view of a bow limb pocket attached to a handle member.
Figure 4:
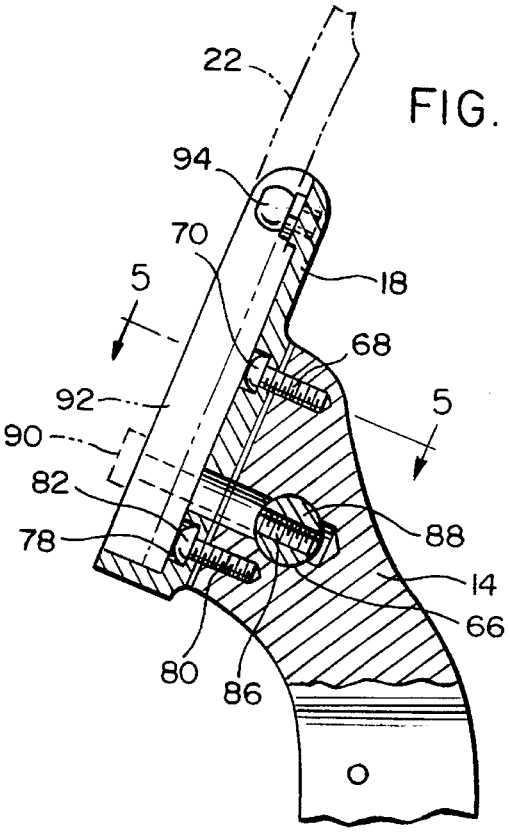
FIG. 4 is a sectional view taken along line 4—4 of FIG. 3.

The channel 76 receives-an end of the bow limbs 22 or 24 as shown in dotted lines in FIGS. 3 and 4. As shown in FIG. 4, with the bolts 68 and 80 securing the bow limb pocket 18 to the end 14 of handle member 12, the bow limb 22 is secured in the channel 76 by a bolt 86 extending through opening 54 and passing into opening 62 and engaging a threaded cylindrical plug 88 mounted within opening 66. The shaft of the bolt 86 is of a diameter less than the diameter of the openings 54 and 62 so that the shaft may be shifted in a direction perpendicular to the longitudinal axis of the handle member 12. A bolt head 90 sits on top of an outermost surface 92 of the end of the bow limb 22. The bow limb pocket also includes bearing lugs 94 which extend into recesses of the bow limb to provide a flex region for bending of the bow limbs during tensioning of the compound bow.

Advantageously, if the pulleys 30, 32 need a fine adjustment in a lateral direction, the bow limbs 22, 24 are removed from the channel 76 of the bow limb pockets 18, 20 and the heads 70, 82 of bolts 68, 80 are loosened. The bow limb pockets are then moved in a direction perpendicular to the longitudinal axis of the handle portion in the directions of arrows 40, 42, 44 or 46 and the bolt heads 70, 82 retightened with the grooves 48 of the bow limb pockets and the grooves 56 of the ends of the handle portion mating with each other with a secure grip. This fine adjustment of the position of the bow pulleys produces a precisely aligned and tuned compound bow.

Having described the invention, many modifications thereto will become apparent to those skilled in the art to which it pertains without deviation from the spirit of the invention as defined by the scope of the appended claims.

I claim:

1. A compound bow comprising:

a handle portion having opposite ends and a longitudinal axis, two bow limbs, and adjustment means connecting said two bow limbs to said opposite ends of said handle portion for lateral adjustable movement of said two bow limbs in a direction perpendicular to said longitudinal axis of said handle portion, said adjustment means including complementary shaped grooves and serrations extending parallel to said longitudinal axis of said handle portion and located on said opposite ends of said handle portion and on two bow limb pockets secured to said opposite ends of said handle portion, an end of each of said two bow limbs being secured in a respective one of said two bow limb pockets.

2. A compound bow as claimed in claim 1, wherein each of said two bow limb pockets include a channel for receipt of said two bow limbs.

3. A compound bow as claimed in claim 2, wherein each of said two bow limbs are secured to a respective one of said two bow limb pockets and a respective one of said opposite ends of said handle portion by a bolt passing through said bow limb, said bow limb pocket and into said handle portion.

4. A compound bow as claimed in claim 3, wherein said bolt extends into a plug slidably mounted in said handle portion.

5. A compound bow as claimed in claim 1, wherein said bow limb pocket is secured to said handle portion by at least one bolt having a head fitting within a recessed slot of said bow limb pocket.

6. A compound bow as claimed in claim 5, wherein said head of said bolt is covered by said bow limb mounted in said bow limb pocket.

7. A compound bow comprising:

a handle portion having opposite ends and a longitudinal axis, two bow limbs, one end of each of said two bow limbs including a pulley member with a bow string extending between said pulley members, and adjustment means connecting an opposite end of said two bow limbs to said opposite ends of said handle portion for lateral adjustable movement of said two bow limbs in a direction perpendicular to said longitudinal axis of said handle portion, said adjustment means including complementary shaped grooves and serrations extending parallel to said longitudinal axis of said handle portion and located on said opposite ends of said handle portion and on two bow limb pockets secured to said opposite ends of said handle portion,.

an end of each of said two bow limbs being secured in a respective one of said two bow limb pockets.

8. A compound bow as claimed in claim 7, wherein each of said two bow limb pockets include a channel for receipt of said two bow limbs.

9. A compound bow as claimed in claim 8, wherein said two bow limbs are secured to a respective one of said two bow limb pockets and a respective one of said opposite ends of said handle portion by a bolt passing through said bow limb, said bow limb pocket and into said handle portion.

10. A compound bow as claimed in claim 9, wherein said bolt extends into a plug slidably mounted in said handle portion.

11. A compound bow as claimed in claim 7, wherein said bow limb pocket is secured to said handle pocket by at least one bolt having a head fitting within a recessed slot of said bow limb pocket.

12. A compound bow as claimed in claim 11, wherein said head of said bolt is covered by said bow limb mounted in said bow limb pocket.

* * * * *